US008926407B2

(12) United States Patent
Lewkoski et al.

(10) Patent No.: US 8,926,407 B2
(45) Date of Patent: Jan. 6, 2015

(54) DEVICES AND METHODS FOR REMOVING A COATING ON A SURFACE OF A SUBMERGED PIPELINE

(71) Applicant: Illinois Tool Works Inc., Glenview, IL (US)

(72) Inventors: Randy D. Lewkoski, Shiner, TX (US); Timothy P. Sheehan, Cypress, TX (US)

(73) Assignee: Illinois Tool Works Inc., Glenview, IL (US)

( * ) Notice: Subject to any disclaimer, the term of this patent is extended or adjusted under 35 U.S.C. 154(b) by 217 days.

(21) Appl. No.: 13/655,657

(22) Filed: Oct. 19, 2012

(65) Prior Publication Data

US 2013/0109282 A1 May 2, 2013

Related U.S. Application Data

(60) Provisional application No. 61/554,155, filed on Nov. 1, 2011.

(51) Int. Cl.

| | |
|---|---|
| ***B24B 3/36*** | (2006.01) |
| ***B08B 9/023*** | (2006.01) |
| ***B24B 27/04*** | (2006.01) |
| ***B24B 29/00*** | (2006.01) |
| ***B24D 13/10*** | (2006.01) |
| ***B24B 5/36*** | (2006.01) |

(52) U.S. Cl.

CPC ..... *B08B 9/023* (2013.01); *B24B 27/04* (2013.01); *B24B 29/005* (2013.01); *B24D 13/10* (2013.01); *B24B 5/363* (2013.01)

USPC ..... 451/178; 451/342; 451/344; 451/348; 451/547; 451/541; 15/179; 15/198

(58) Field of Classification Search

CPC ..... B24B 5/04; B24B 5/12; B24B 5/167; B24B 5/363; B24B 27/033; B24B 27/04; B24B 29/08; A46B 13/001; A46B 13/003

USPC ..... 451/49, 51, 29–31, 178, 342, 344, 348, 451/541–547; 15/179, 198

See application file for complete search history.

(56) References Cited

U.S. PATENT DOCUMENTS 2,000,772 A * 5/1935 McGill ..... 451/542
2,147,438 A * 2/1939 Hassler ..... 451/546

(Continued)

FOREIGN PATENT DOCUMENTS

EP 2165804 A2 * 3/2010 ..... B24B 5/36
GB 2082948 3/1982

OTHER PUBLICATIONS

European Patent Office, The International Searching Authority, International Search Report and Written Opinion for PCT/US2012/062089, Date of Mailing Jun. 20, 2013, 14 pages.

*Primary Examiner* — George Nguyen
(74) *Attorney, Agent, or Firm* — Klintworth & Rozenblat IP LLC

(57) ABSTRACT

Devices for removing a coating on a pipe are provided. In one aspect, a device for removing a coating on a pipe includes a sleeve, an arm coupled to the sleeve, and a wheel coupled to the arm. The sleeve includes a wall and an aperture defined through the wall. The wall defines a cavity in the sleeve and the sleeve is adapted to receive the pipe in the cavity. The device also includes a wheel coupled to the arm and adapted to extend through the aperture to engage the coating on the pipe.

19 Claims, 9 Drawing Sheets

(56) References Cited

U.S. PATENT DOCUMENTS

| | | | | | |
|---|---|---|---|---|---|
| 2,257,619 | A | * | 9/1941 | Prill | 451/441 |
| 2,600,481 | A | * | 6/1952 | Clyde | 409/140 |
| 2,763,257 | A | * | 9/1956 | Asbury | 125/5 |
| 2,769,468 | A | * | 11/1956 | Swanson | 144/208.92 |
| 2,962,745 | A | * | 12/1960 | Pedersen | 15/198 |
| 3,071,903 | A | * | 1/1963 | Wing et al. | 451/441 |
| 3,852,917 | A | * | 12/1974 | McKown | 451/69 |
| 4,007,705 | A | * | 2/1977 | Sherer et al. | 118/710 |
| 4,043,167 | A | * | 8/1977 | Koser | 72/340 |
| 4,086,732 | A | * | 5/1978 | Ramsey | 451/49 |
| 4,092,758 | A | * | 6/1978 | Horton et al. | 15/180 |
| 4,143,489 | A | * | 3/1979 | Sogner | 451/135 |
| 4,205,694 | A | * | 6/1980 | Thompson et al. | 134/181 |
| 4,445,248 | A | * | 5/1984 | Hait | 15/198 |
| 5,070,654 | A | * | 12/1991 | Manqvist et al. | 451/271 |
| 5,107,633 | A | * | 4/1992 | Rose | 451/92 |
| 5,136,969 | A | * | 8/1992 | Chapman | 118/305 |
| 5,244,505 | A | * | 9/1993 | Allison et al. | 134/22.11 |
| 5,385,609 | A | * | 1/1995 | Rose et al. | 118/119 |
| 5,398,461 | A | * | 3/1995 | Rose | 451/92 |
| 5,615,696 | A | * | 4/1997 | Lawler | 134/104.2 |
| 5,616,068 | A | * | 4/1997 | Soderberg | 451/49 |
| 5,628,675 | A | * | 5/1997 | Brown et al. | 451/49 |
| 6,241,590 | B1 | * | 6/2001 | Heijkenskjold | 451/181 |
| 7,044,041 | B1 | | 5/2006 | Chalkowsky | |
| 7,537,065 | B2 | | 5/2009 | Gallagher et al. | |
| 2003/0172484 | A1 | * | 9/2003 | Lendabarker | 15/180 |
| 2008/0227372 | A1 | * | 9/2008 | Mandel et al. | 451/324 |
| 2010/0154153 | A1 | * | 6/2010 | Hooper et al. | 15/104.05 |
| 2011/0097157 | A1 | * | 4/2011 | Swiatowy et al. | 405/184.1 |

* cited by examiner

DEVICES AND METHODS FOR REMOVING A COATING ON A SURFACE OF A SUBMERGED PIPELINE

RELATED APPLICATIONS

The present application claims the benefit of U.S. Provisional Patent Application No. 61/554,155, filed Nov. 1, 2011, the entire contents of which are incorporated herein by reference.

BACKGROUND

Submerged pipes that extend from offshore drilling platforms to land based facilities frequently require repair, and replacement of defective sections. To repair a defective section of submerged pipe, the pipe is cut to remove the defective section and a replacement portion is positioned between the cut ends of the preexisting pipe.

To protect metal pipes from deterioration caused by sea water, the outer surface of such submerged pipes are coated with a fusion bonded epoxy (FBE) or a polypropylene coating, and such coatings must be removed from the outer surface of the pipe in preparation of bonding the replacement portion of the pipe to preexisting portions of the pipe. The coating must be removed from the ends of the replacement portion and the ends of the preexisting pipe. There is a need for an improved device for removing such surface coatings from the circumference of the pipe adjacent ends of the pipe.

SUMMARY

The present invention is defined by the following claims, and nothing in this section should be taken as a limitation on those claims.

In one aspect, a device for removing a coating on a pipe is provided. The device includes a sleeve including a wall and an aperture defined through the wall. The wall defines a cavity in the sleeve and the sleeve is adapted to receive the pipe in the cavity. The device also including an arm coupled to the sleeve and a wheel coupled to the arm and adapted to extend through the aperture to engage the coating on the pipe.

In another aspect, a device for removing a coating on a pipe is provided. The device includes a tubular sleeve including a cylindrical side wall having a longitudinal extent and a first diameter, an end wall positioned at a first end of the cylindrical side wall and transverse to the longitudinal extent of the cylindrical side wall, a cavity defined by the cylindrical side wall and the end wall and adapted to receive the pipe therein, an aperture defined through the cylindrical side wall and having a longitudinal extent substantially parallel to the longitudinal extent of the cylindrical side wall, and a bellmouth positioned at a second end of the sleeve opposite the end wall and including a second diameter larger than the first diameter. The device also includes a bracket coupled to the sleeve, a feed screw supported by and rotatable relative to the bracket, a slide coupled to and movable along the feed screw relative to the sleeve, an arm coupled to and movable with the slide relative to the sleeve, a wheel coupled to and movable with the arm relative to the sleeve, wherein the wheel is adapted to rotate relative to the arm, and an actuator coupled to the arm and adapted to move the wheel between an engaged position, in which the wheel engages the pipe to remove the coating, and a disengaged position, in which the wheel is disengaged from the pipe.

In a further aspect, an abrasive wheel is provided and includes a hub having a periphery and defining a channel in a side of the hub, an abrasive member partially positioned in the channel and including a portion thereof that extends out of the channel beyond the periphery of the hub, and a side plate coupled to the hub to secure the abrasive member in the channel between the hub and the side plate.

In a yet another aspect, a device is provided for removing a coating on a surface from a length of pipe having an end, an outer diameter and a cylindrical body. The device includes a tubular sleeve having an outer wall with an opening in the wall that extends from the outer surface thereof to the inner surface. The inner opening of the sleeve has a diameter that is a little larger than the diameter of the length of pipe for which the surface is to be removed such that the tubular sleeve is slideable over the end of the length of pipe. Coupled to the outer surface of the sleeve is an arm, and coupled to the end of the arm is a motor for rotating an abrasive wheel. The arm is oriented to position the abrasive wheel to extend through the opening in the wall of the sleeve and contact the coating on the outer surface of the pipe when the sleeve is fitted around the pipe. Rotation of the abrasive wheel will therefore remove a portion of the coating on the outer surface of the length of pipe.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

Figure 1:
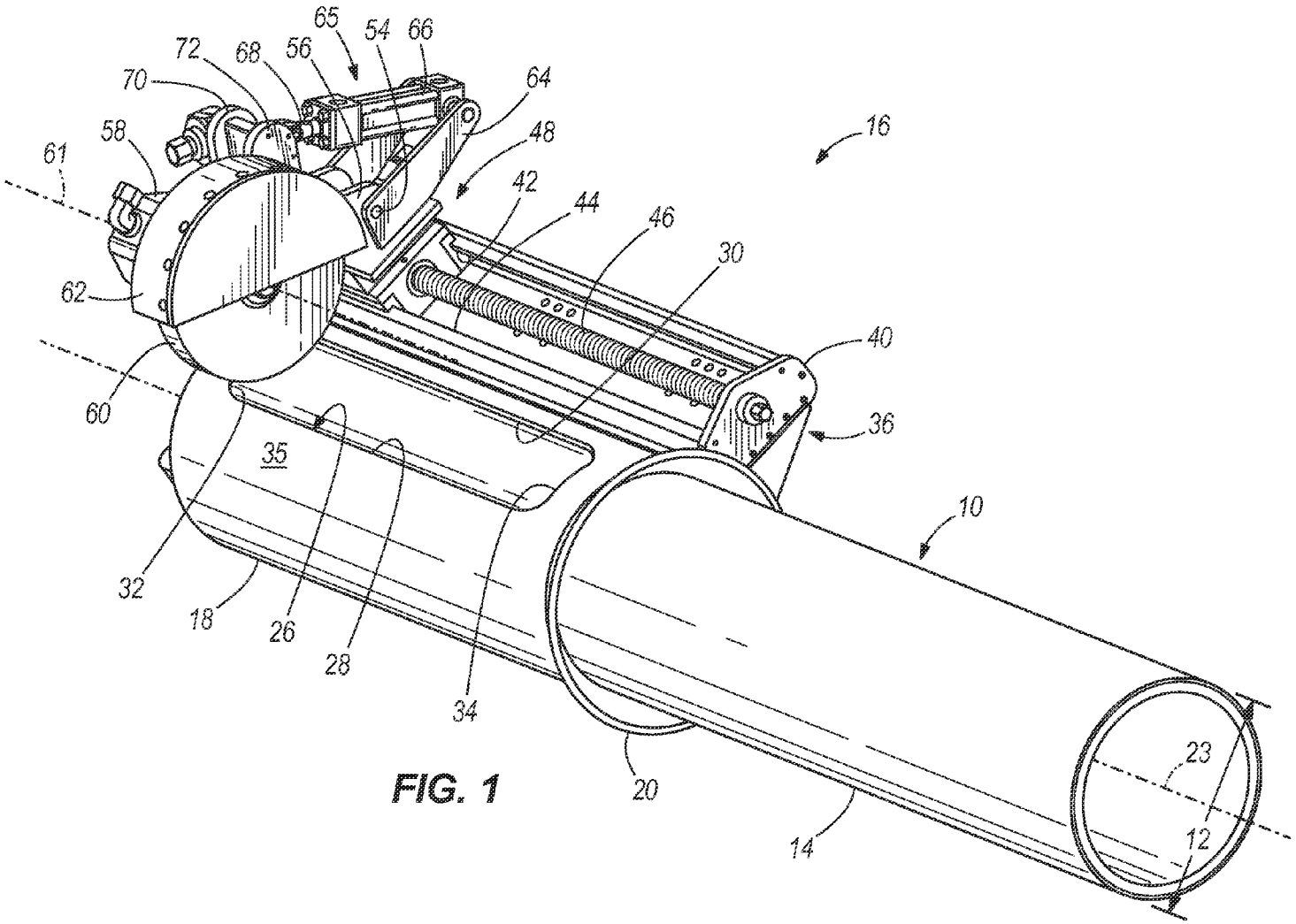
FIG. 1 is a top left isometric view of a device and an exemplary pipe, in accordance with one embodiment.
Figure 2:
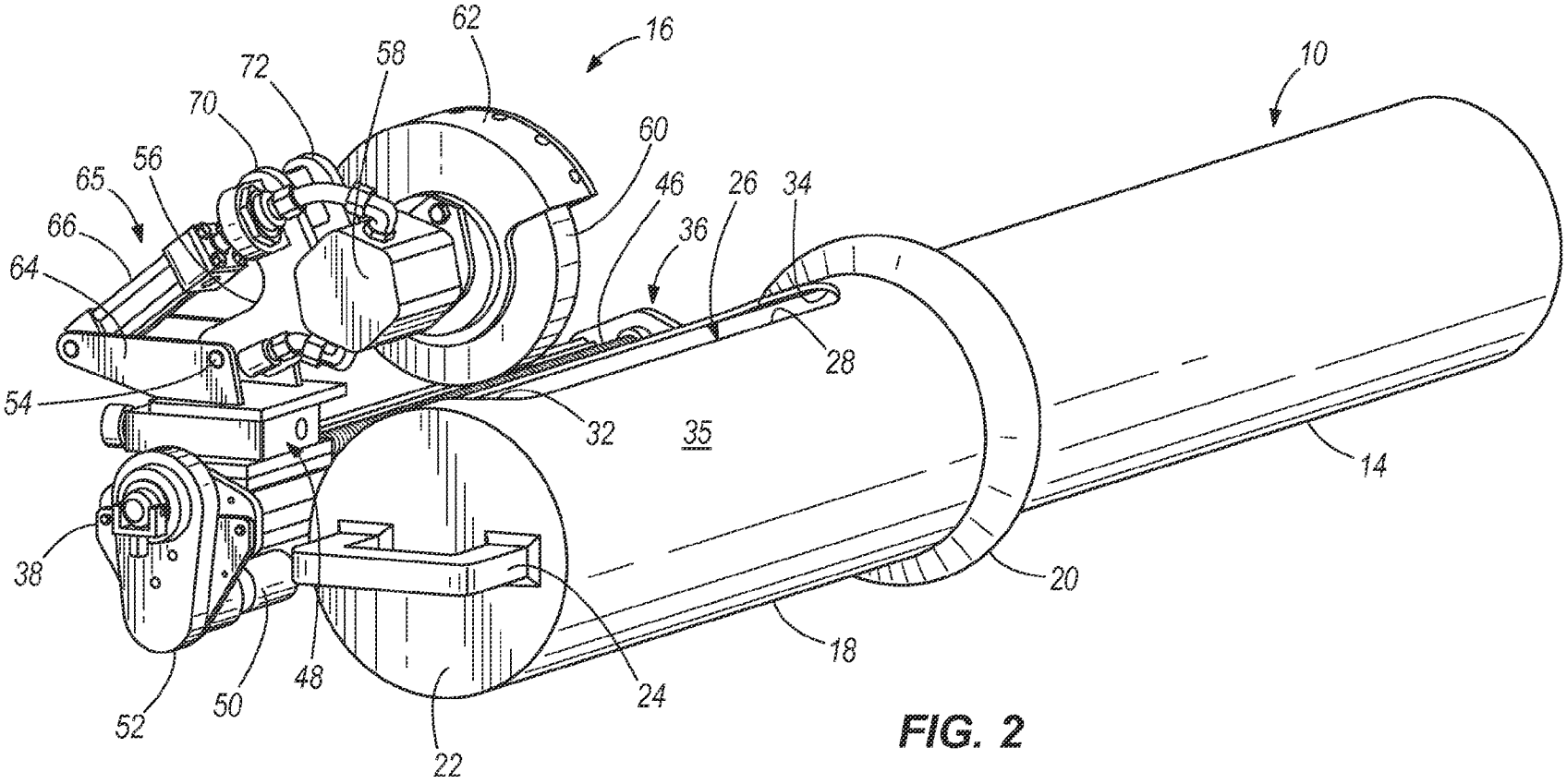
FIG. 2 is a top right isometric view of the device shown in FIG. 1, in accordance with one embodiment.
Figure 3:
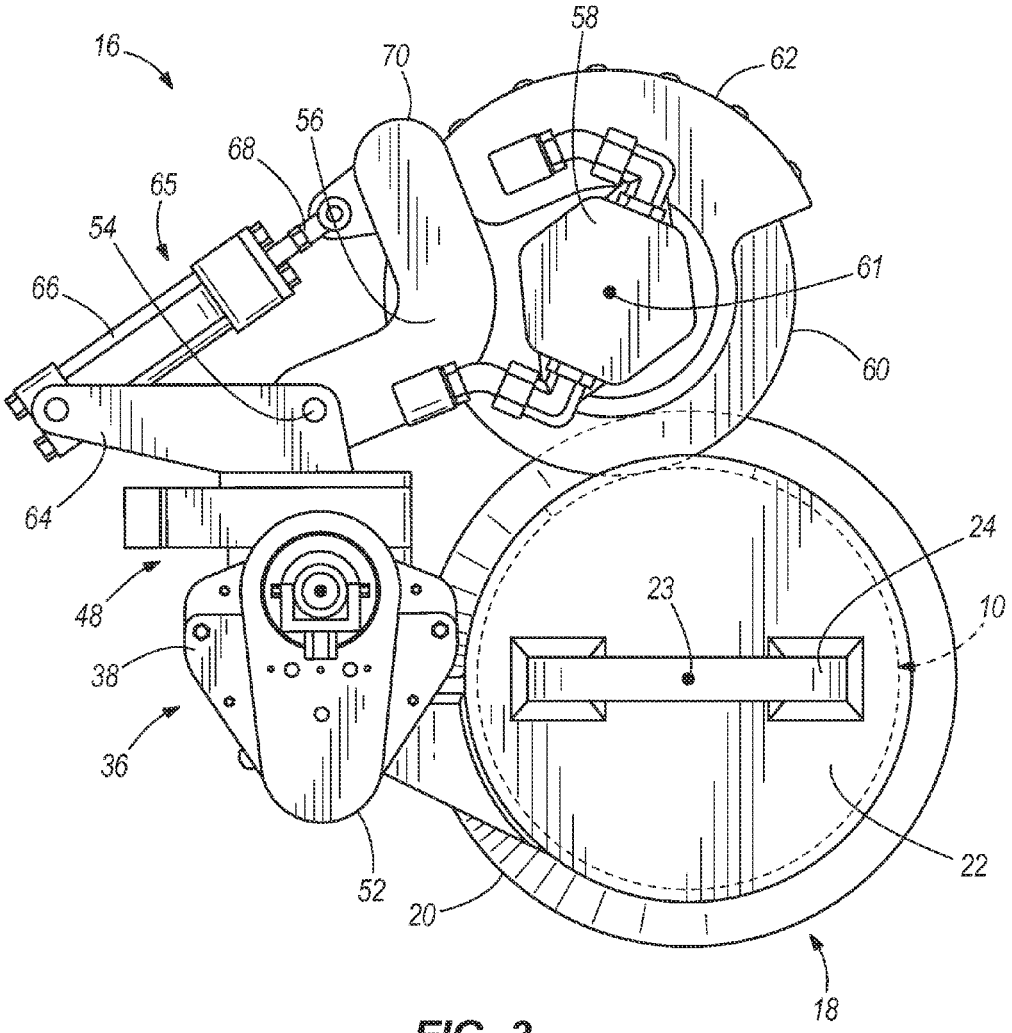
FIG. 3 is a right side elevational view of the device shown in FIGS. 1 and 2.
Figure 4:
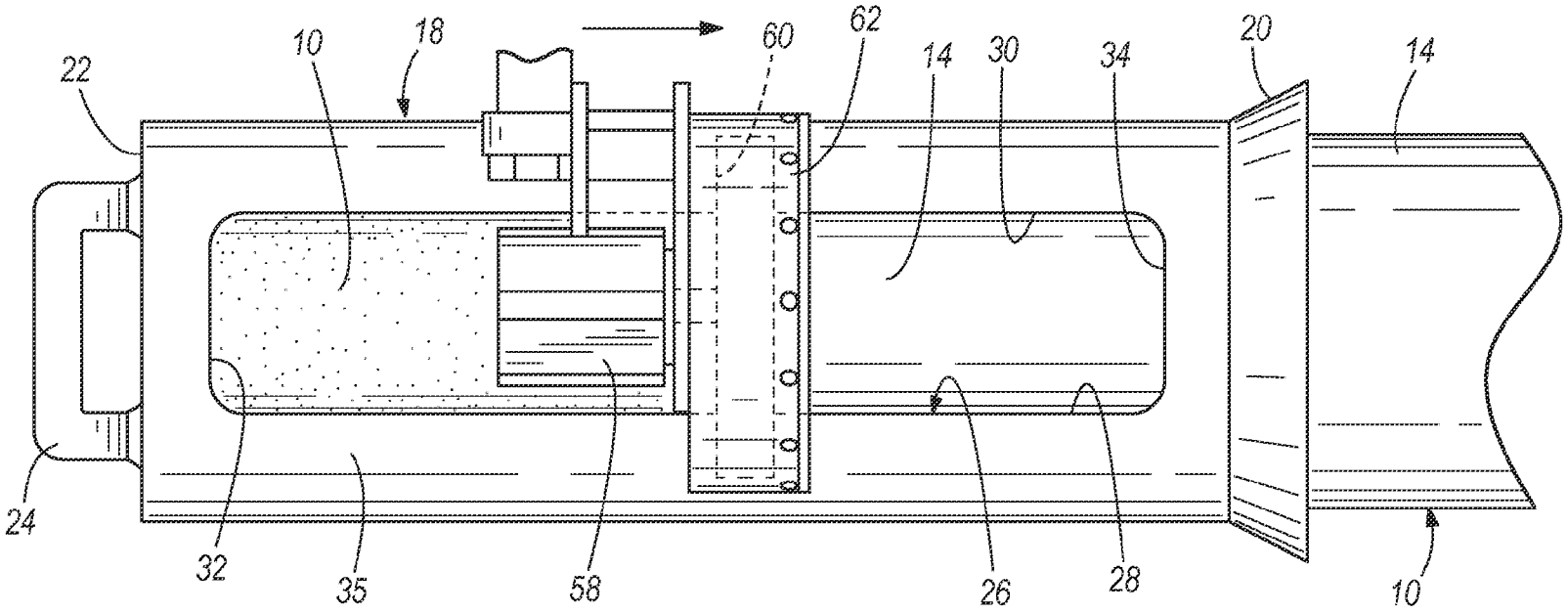
FIG. 4 is a top view of the device shown in FIGS. 1-3.

Devices and methods are disclosed herein for servicing underwater pipeline and, more particularly, for removing a coating from around a circumference of an end of a submerged length of pipe.

Referring to FIGS. 1-4, to prepare an end of a submerged length of pipe 10 for receiving a replacement portion with the pipe 10 including a diameter 12 and an outer coating 14 of fusion bonded epoxy or polypropylene, a portion of the coating 14 that extends around the open end of the pipe 10 must be removed. A device 16 is provided to remove a portion of the coating 14 from the pipe 10.

The device 16 includes a sleeve 18 that is generally tubular or cylindrical in shape. The sleeve 18 includes a flared bellmouth 20 at one end thereof and a transverse surface 22 (traverse to a longitudinal axis 23 of the sleeve 18) at the other end thereof. The bellmouth 20 has a larger diameter than the remainder of the sleeve 18 and tapers from the large diameter of the bellmouth 20 to the smaller diameter of the remainder of the sleeve 18. A handle 24 is coupled to the transverse surface 22 and is sufficiently large to be grasped by a manipulating arm of a remote operated submersible vehicle (ROV), not shown. A control cable extends from the ROV to an operator above a surface of the water. The sleeve 18 further includes an elongate aperture 26 therein having parallel spaced apart sides 28, 30, a first end 32 spaced a short distance from the transverse surface 22 and a second end 34 spaced a short distance from the bellmouth 20.

Extending longitudinally along an outer surface 35 of the sleeve 18 is an elongate mounting bracket 36 having a first end 38 adjacent the surface 22 of the sleeve 38 and a second end 40 adjacent the bellmouth 20. Extending along the mounting bracket 36 are spaced apart parallel guides 42, 44, and a rotatable feed screw 46 is rotatably coupled between the first and second ends 38, 40 of the bracket 36.

A slide 48 couples to and linearly moves along guides 42, 44, and a threaded nut is within the slide 48 that threadedly engages the feed screw 46 such that rotation of the feed screw 46 causes linear movement of the slide 48 along the guides 42, 44. Also coupled to the mounting bracket 36 is a rotatable motor 50 that drives the feed screw 46 through a gearing in an enclosed housing 52. Rotation of the motor 50 in one direction will move the slide 48 in a first direction between the ends 38, 40 of the bracket 36 and rotation of the motor 50 in an opposite direction will move the slide 48 in a second direction opposite the first direction between the ends 38, 40 of the bracket 36. Pivotally coupled to the slide 48 by a pivot pin 54 is a moveable arm 56 and at the outer end of the arm 56 is a hydraulic motor 58 adapted to rotate a wheel 60. The wheel 60 is abrasive and is adapted to engage and remove the coating 14 from the pipe 10. The wheel 60 may have a variety of different configurations and abrasive capabilities, and all of such possibilities are intended to be within the spirit and scope of the present invention. One exemplary wheel 60 is described below in more detail.

As shown in the drawings, the mounting bracket 36 that supports the moveable arm 56 also support the wheel 60 for rotation around an axis 61 that is substantially parallel to the longitudinal axis 23 of the sleeve 18. In other exemplary embodiments, the wheel 60 may rotated around an axis that is not parallel to the longitudinal axis 23, but rather the rotational axis may be at an angle or inclined relative to the longitudinal axis 23. A portion of the outer surface of the wheel 60 is positionable between the sides 28, 30 of the aperture 26 of the sleeve 18. The wheel 60 is movable toward the pipe 10 to position the outer circumference of the wheel 60 through the aperture 26 and engage the coating 14 of the pipe 10 at a position near the first end 32 when the slide 48 is near the first end 38 of mounting bracket 36. The wheel 60 is movable along pipe 10 and can engage the pipe 10 near the second end 34 when the slide 48 is near the second end 40 of the mounting bracket 36. A guard 62 is coupled adjacent the motor 58 and extends around a portion of the wheel 60 to inhibit injury to divers and equipment located near the device 16.

The slide 48 further includes a bracket 64 and an actuator 65. In the illustrated exemplary embodiment, the actuator 65 is a hydraulic actuator and includes a hydraulic ram 66 rotatably coupled at one end to the bracket 64 and a piston rod 68 coupled to the ram 66 for extension and retraction. The outer end of the piston rod 68 is rotatably coupled between a pair of mounting ears 70, 72 on the arm 56 such that extension of the piston rod 68 urges the wheel 60 into and through the aperture 26 toward the pipe 10 and retraction of the piston rod 68 draws the wheel 60 away from the pipe 10 and out of the aperture 26. In other exemplary embodiments, the actuator 65 may be other types of actuators including, but not limited to, pneumatic, screw drive, or any other type of actuator, and all of such various types of actuators are intended to be within the spirit and scope of the present invention.

To remove a coating 14 from around an outer end of a length of pipe 10, an ROV is used to position the sleeve 18 of the device 16 over the end of the pipe 10. The bellmouth 20 aids in positioning the sleeve with respect to the pipe 10. An arm, not shown, of the ROV grasps the handle 24 for retaining the sleeve 18 against the end of the pipe 10, and rotates the sleeve 18 with respect to the pipe 10 as the device 16 is operated. The motor 50 operates to position the slide 48 near the first end 38 of the mounting bracket 36 and the motor 58 energizes to rotate the wheel 60. Motor 58 is adapted to rotate the wheel 60 in either direction as desired. Hydraulic controls are also used to operate the ram 66, extend the piston rod 68, and bring the wheel 60 into contact with the coating 14 on the outer surface of the pipe 10 within the aperture 26. The piston rod 68 ensures proper pressure between the outer surface of the wheel 60 and the surface of the pipe 10 that is exposed by the aperture 26. As the wheel 60 rotates, the abrasive elements thereon remove the coating 14 on the surface of the pipe 10.

The motor 50 operates as needed to rotate the feed screw 46 and move the slide 48 longitudinally along the guides 42, 44 between the first and second ends 36, 40 of the bracket 36 for removing a strip of coating 14 from the surface of the pipe 10 a desired distance in from the end of the pipe 10. The wheel 60 removes the coating 14 in a direction generally parallel to a longitudinal axis of the pipe 10. The ROV is also controlled to turn the handle 24 to rotate the sleeve 18 with respect to the end of the pipe 10 causing the wheel 60 to advance around the circumference of the pipe 10 until the wheel 60 has removed the coating 14 around the entire circumference of the pipe 10.

Figure 5:
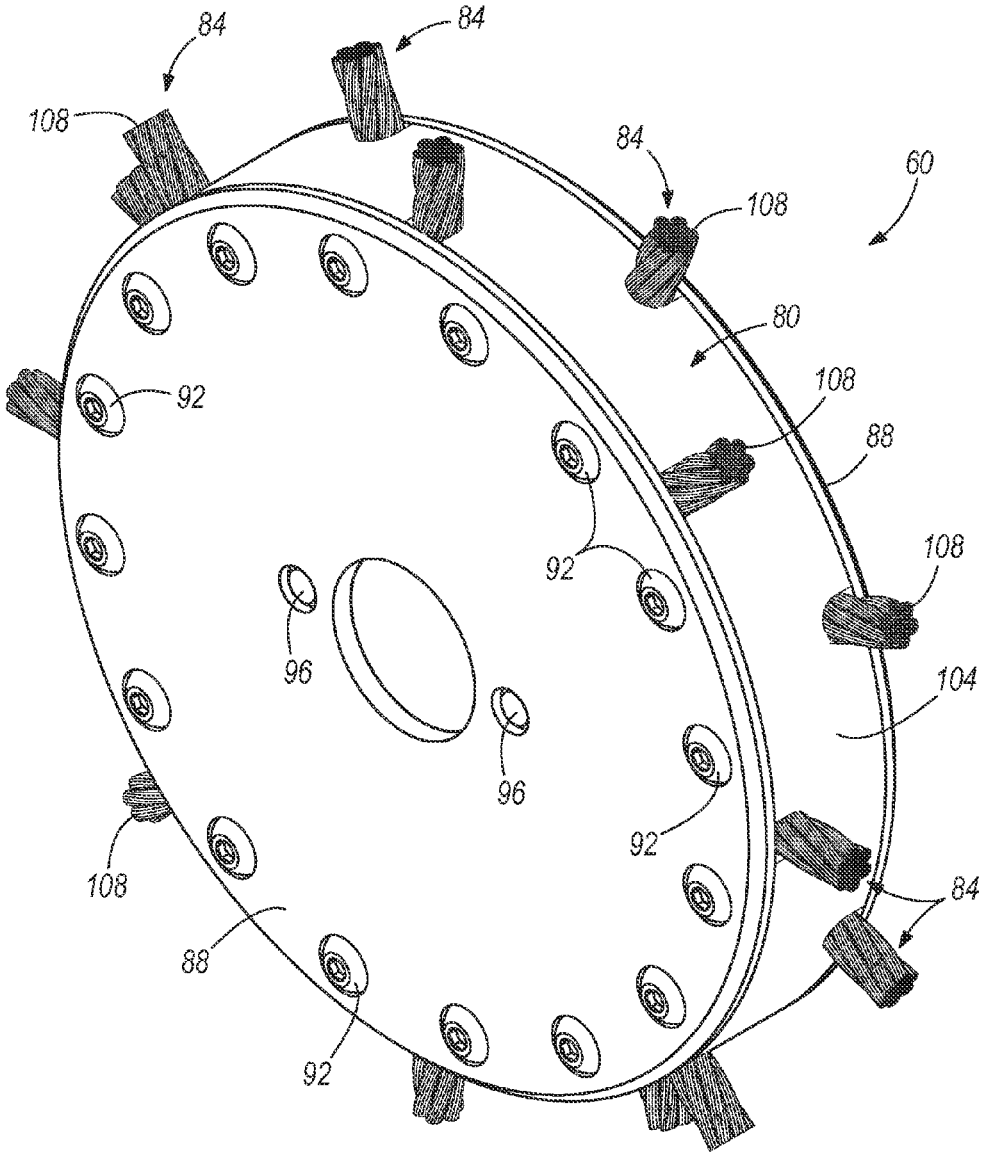
FIG. 5 is an isometric view of an exemplary abrasive wheel of the device, in accordance with one embodiment.
Figure 6:
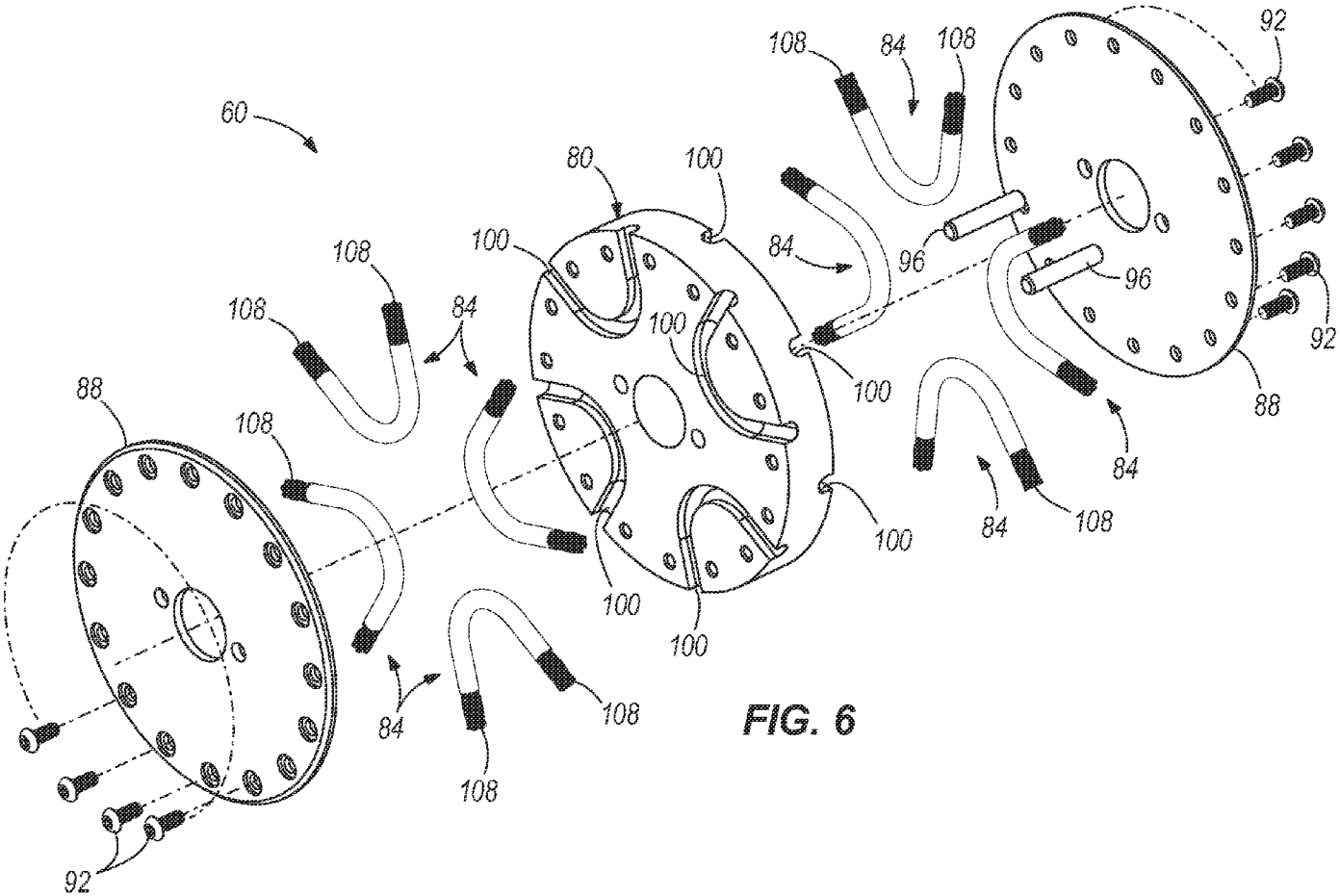
FIG. 6 is an exploded view of the abrasive wheel shown in FIG. 5 with a portion of the abrasive members illustrated in detail and a portion schematically for simplicity, in accordance with one embodiment.
Figure 7:
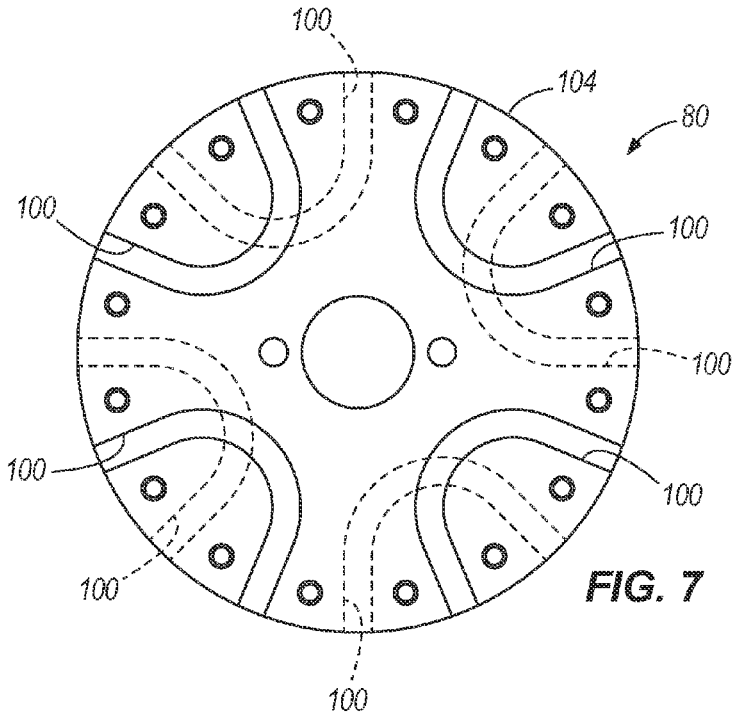
FIG. 7 is a side view of a hub of the abrasive wheel shown in FIG. 5 illustrating abrasive member channels in dashed lines, in accordance with one embodiment.

Referring now to FIGS. 5-7, an exemplary wheel 60 is illustrated for engaging and removing a coating 14 from a pipe 10. In the illustrated exemplary embodiment, the wheel 60 includes a hub 80, a plurality of abrasive members 84, a pair of side plates 88 with one of the side plates 88 coupled to each side of the hub 80, a plurality of fasteners 92 for coupling the side plates 88 to the hub 80, and a pair of pins 96 for providing a positive coupling to a drive member associated with the motor 58. The hub 80 and side plates 88 may be made of a wide variety of materials such as, for example, the hub 80 may be made of 7075 aluminum and the side plates 88 may be made of 6061 aluminum.

The hub 80 defines a plurality of channels 100 in each side thereof for receiving abrasive members 84. In the illustrated exemplary embodiment, each side of the hub 80 defines four channels 100 for receiving four abrasive members 84. Alternatively, each side of the hub 80 may define any number of channels 100 therein for receiving a corresponding number of abrasive members 84. The channels 100 are arcuate in shape and both ends of the arcuate channels 100 open up to a periphery 104 of the hub 80. The channels 100 defined in a first side of the hub 80 are offset with the channels 100 defined in a second opposing side of the hub 80 as shown in FIG. 7 to provide alternating offset abrasive members 84 extending from a periphery 104 of the wheel 60. When the side plates 88 are coupled to the hub 80 with the fasteners 92, the side plates 88 retain the abrasive members 84 within the channels 100 to ultimately secure the abrasive members 84 to the wheel 60. The side plates 88 may be removed to allow replacement of the abrasive members 84 as desired.

The wheel 60 is capable of including a wide variety of different types of abrasive members 84 having a wide variety of configurations, materials, characteristics, etc., and all of such possibilities are intended to be within the spirit and scope of the present invention. In the illustrated exemplary embodiment, each abrasive member 84 is comprised of a wire rope. Any type, size, and length of wire rope 84 may be utilized with the wheel 60. For example, the wire rope 84 may be a stainless steel one-half (½) inch diameter 7×19 wire rope. Also, for example, the wire rope 84 may be a stainless steel one-half (½) inch diameter 7×7 wire rope or a 6×37 wire rope. Moreover, the wire rope 84 may be made out of other materials such as, for example, improved plow steel (IPS), carbon steel, etc. The channels 100 and length of the abrasive members 84 correspond to enable both ends 108 of the abrasive member 84 to extend out of the channels 100 and beyond the periphery 104 of the wheel 60. The ends 108 of each abrasive member 84 may extend beyond the periphery 104 of the wheel 60 any distance. In one exemplary embodiment, the ends 108 of the abrasive members 84 extend about one-half (½) inch out of the periphery 104 of the wheel 60. In other exemplary embodiments, the ends 108 of the abrasive members 84 extend between about three-eighths (⅜) of an inch to about three-quarters (¾) of an inch out of the periphery 104 of the wheel 60. In further exemplary embodiments, the ends 108 of abrasive members 84 may extend out of the periphery 104 of the wheel 60 at different distances.

The distance that the abrasive member 84 extends out of the wheel 60 depends on the desired stiffness of the abrasive member 84. Having an abrasive member 84 extend too far out from the wheel 60 decreases the stiffness and may cause the abrasive member 84 to bend too much, thereby creating a negative rake angle and providing undesirable performance. Having an abrasive member 84 extend too little out from the wheel 60 increases the stiffness and may damage the outer surface of the pipe 10 if it contacts the pipe 10 after removal of the coating 14.

As indicated above, the motor 58 may rotate the wheel 60 in either direction. In embodiments where the abrasive member 84 is a wire rope, rotation of the wheel 60 in a single direction for a period of time may cause the wire rope 84 to deform in one direction and wear unevenly on the side contacting the coating 14. Rotating the wheel 60 in the opposite direction causes the other side of the wire rope 84 to contact the coating 14, thereby deforming the wire rope 84 in the other direction and wearing the other side of the wire rope 84. Rotation of the wheel 60 in both directions may provide for more even wearing and an increased life of the wire ropes 84.

It should be understood that the wheel 60 is adapted to offer great variability in the levels of stiffness and, therefore, has the ability to accommodate a wide variety of applications and circumstances. Moreover, the ability to adjust the type of abrasive member, the material of the abrasive member, and the distance the abrasive member extends beyond the periphery of the wheel all provide a vast array of stiffnesses.

Figure 8:
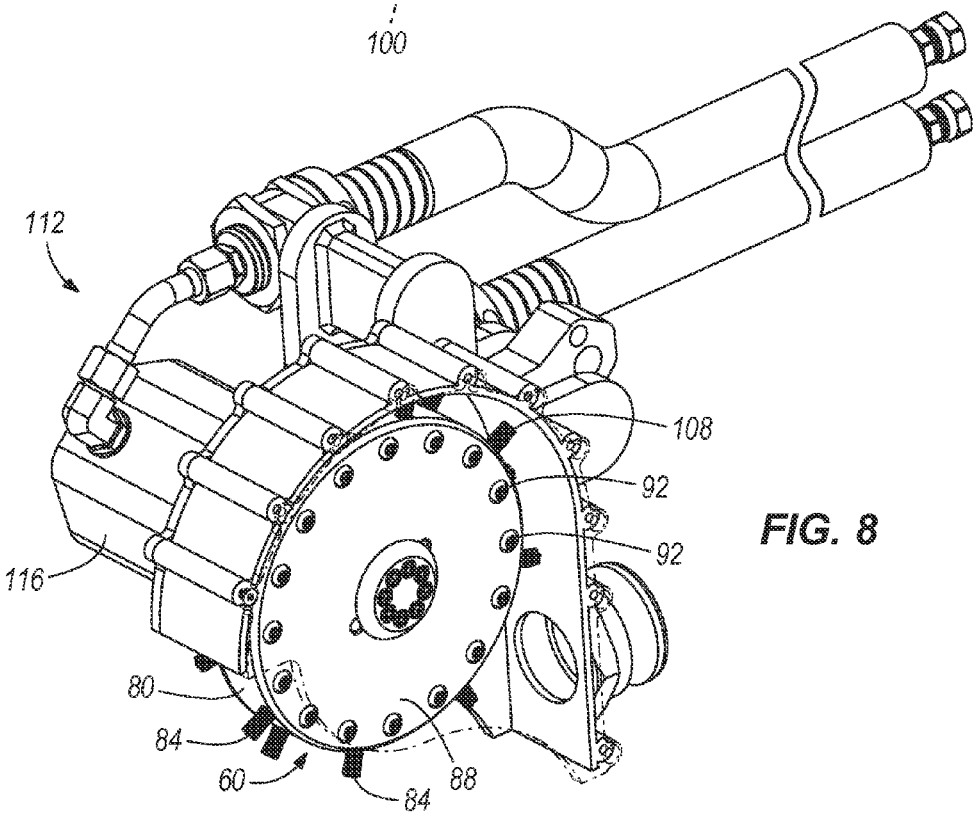
FIG. 8 is a top front isometric view of the abrasive wheel shown in FIG. 5 illustrated in another exemplary application, in accordance with one embodiment.

Referring now to FIG. 8, another exemplary environment in which the wheel 60 may be used is illustrated. In this illustrated embodiment, the wheel 60 is used with a coating removal apparatus 112. The apparatus 112 includes a motor 116 for rotating the wheel 60 in either direction. The apparatus 112 may be moved along a pipe that requires a coating to be removed. The wheel 60 is adapted to be utilized in a wide variety of applications and environments, and all of such possibilities are intended to be within the spirit and scope of the present invention.

Figure 9:
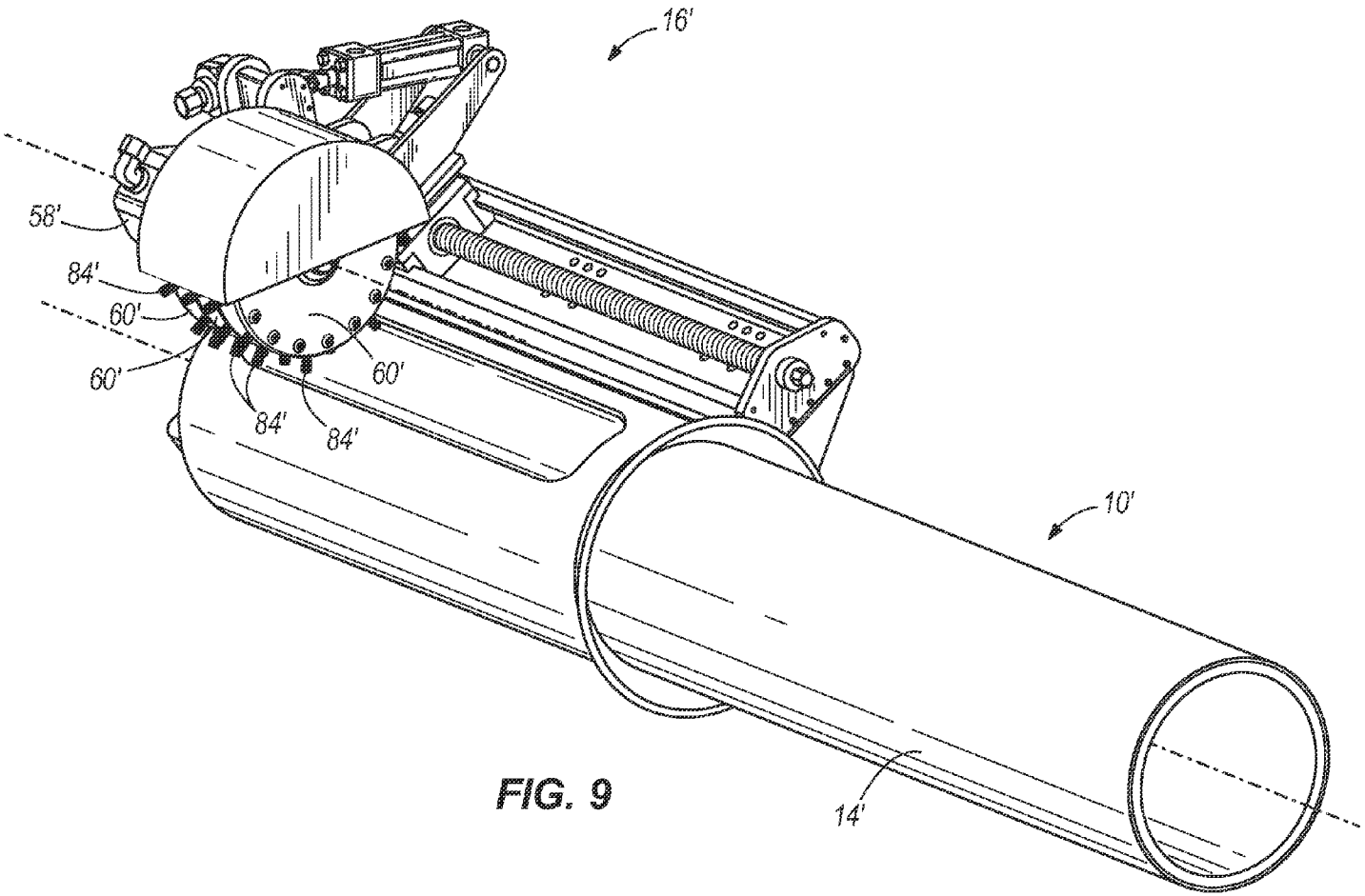
FIG. 9 is a top front perspective view of a plurality of abrasive wheels shown in FIG. 5 stacked together and utilized in the device shown in FIG. 1, in accordance with one embodiment.

With reference to FIG. 9, another exemplary embodiment of the device 16' is illustrated and is adapted to support a plurality of wheels 60'. The illustrated exemplary embodiment of the device 16' includes three wheels 60'. Alternatively, the device 16' is capable of supporting any number of wheels 60'. The motor 58' rotates the plurality of wheels 60' together and can rotate the wheels 60' together in either direction for removing a coating 14' from the pipe 10'. The inclusion of a plurality of wheels 60' increases the amount of contact between the abrasive members 84' and the coating 14' on the pipe 10', thereby increasing the rate at which the device 16' can remove coating 14'. In other exemplary embodiment, the wheels 60' may rotate in different directions relative to one another. Motor 58' may rotate all the wheels in different directions or multiple motors may be used to rotate the wheels in different directions. Such rotation in different directions may reduce the induced torque the arm supporting the wheels will need to resist during operation of the wheels. For example, one wheel may rotate in a counter clockwise direction, a second wheel rotate in a clockwise direction, and a third wheel rotate in a counter clockwise direction. In embodiments where wheels rotate in different directions relative to one another, the wheels may be on the same spindle or they may be on different spindles. In one example including multiple spindles, the wheels on different spindles may be in substantially the same plane with each other. In another example including multiple spindles, the wheels and spindles are positioned at different locations around the pipe.

Figure 10:
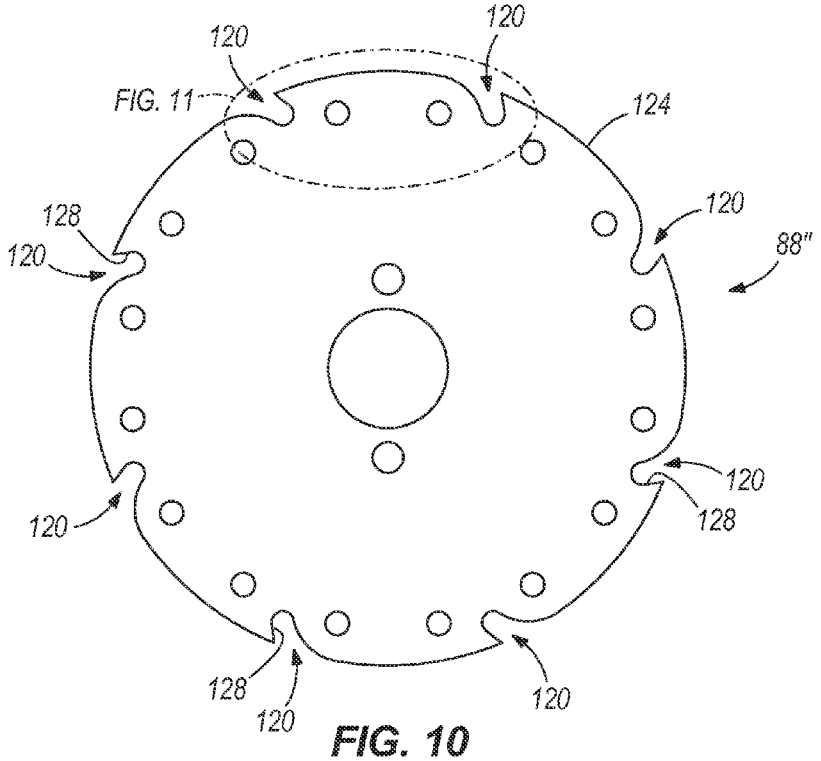
FIG. 10 is a side view of an exemplary side plate of an abrasive wheel, in accordance with one embodiment.
Figure 11:
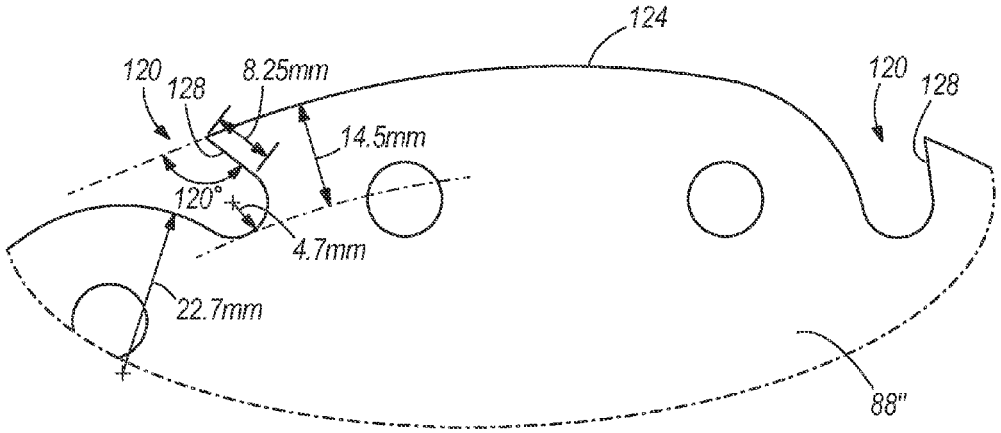
FIG. 11 is an enlarged view of a portion of the side plate shown in FIG. 10.

Referring now to FIGS. 10 and 11, another exemplary side plate 88" is illustrated. The side plate 88" is coupled to the hub in the same manner as the side plates 88 described above in connection with FIGS. 5-7. One side plate 88" is coupled to each of opposing sides of the hub. Each side plate 88" may be made of a wide variety of materials such as, for example, carbon steel. The side plate 88" includes a plurality of cutting members 120 defined in an edge 124 thereof. During operation of the wheel, abrasive members cut a trench in the coating and the side plates 88" may engage the coating at the top of the trench, thereby resisting movement of the wheel along a length of the pipe. The cutting members 120 defined in the edge 124 of the side plate 88" cut the coating away at the top of the trench to ease movement of the wheel along the length of the pipe. The wheel includes a side plate 88" on each side, thereby easing movement of the wheel along the length of the pipe in either direction. Since the abrasive members project beyond the edges 124 of the side plates 88", a spacing is provided between the outer surface of the pipe and the cutting edge 124 of the side plates 88". This spacing inhibits the side plates 88" from engaging and damaging the outer surface of the pipe.

The side plates 88" may include any number and any configuration of cutting members in its edge. In the illustrated exemplary embodiment, the side plate 88" includes eight cutting members 120 generally having a saw tooth shape. Each cutting member 120 includes the dimensions illustrated in FIG. 11. The inclusion of these dimensions and the saw tooth configuration for the cutting member is not intended to be limiting. Rather, the exemplary dimensions and configuration are provided to demonstrate exemplary principles of the wheel. The side plate 88" is capable of including many other possibilities of cutting members. For example, the rake face 128 of the cutting member 120 may have a neutral orientation rather than a positive rake face (see the positive rake angle of 120 degrees in FIG. 11). In such an example, the rake angle may be about 90 degrees rather than 120 degrees. Also, for example, the rake angle may be less than 90 degrees, thereby providing a negative rake angle. Additionally, any of the other dimensions of the cutting member 120 illustrated in FIG. 11 may be a wide variety of different dimensions.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A device for removing a coating on a pipe, the device comprising:

a sleeve including a wall and an aperture defined through the wall, wherein the wall defines a cavity in the sleeve and the sleeve is adapted to receive the pipe in the cavity;

an arm coupled to the sleeve; and a wheel coupled to the arm and adapted to extend through the aperture to engage the coating on the pipe.

2. The device of claim 1, wherein the sleeve is substantially cylindrical in shape.

3. The device of claim 1, wherein the sleeve has a first diameter and further includes a bellmouth positioned near an end of the sleeve, the bellmouth having a second diameter larger than the first diameter.

4. The device of claim 1, wherein the wheel is movable between an engaged position, in which the wheel extends through the aperture and engages the coating on the pipe, and a disengaged position, in which the wheel is moved out of the aperture and is disengaged from the pipe.

5. The device of claim 4, further comprising an actuator coupled to the arm for moving the wheel between the engaged position and the disengaged position.

6. The device of claim 1, further comprising:

a bracket coupled to the sleeve;

a feed screw coupled to the bracket and the arm; and a motor coupled to the feed screw to rotate the feed screw;

wherein the motor is adapted to rotate the feed screw to move the arm and the wheel along the sleeve.

7. The device of claim 6, wherein rotation of the feed screw moves the arm and wheel along the sleeve substantially parallel to a longitudinal extent of the sleeve.

8. The device of claim 7, wherein the aperture has a longitudinal extent that is substantially parallel to the longitudinal extent of the sleeve, and wherein the wheel is adapted to move within the aperture and engage the coating of the pipe as the wheel moves along the sleeve.

9. The device of claim 1, wherein the sleeve is adapted to rotate around the pipe.

10. The device of claim 1, wherein the wall is a side wall of the sleeve, the sleeve further including an end wall and a handle coupled to the end wall.

11. The device of claim 1, wherein the wall is a cylindrical side wall of the sleeve and has a longitudinal extend and a first diameter, the device further comprising:

an end wall positioned at a first end of the cylindrical side wall and transverse to the longitudinal extent of the cylindrical side wall, wherein the cylindrical side wall and the end wall define the cavity; and a bellmouth positioned at a second end of the cylindrical side wall opposite the end wall and including a second diameter larger than the first diameter.

12. A device for removing a coating on a pipe, the device comprising:

a tubular sleeve including a cylindrical side wall having a longitudinal extent and a first diameter, an end wall positioned at a first end of the cylindrical side wall and transverse to the longitudinal extent of the cylindrical side wall, a cavity defined by the cylindrical side wall and the end wall and adapted to receive the pipe therein, an aperture defined through the cylindrical side wall and having a longitudinal extent substantially parallel to the longitudinal extent of the cylindrical side wall, and a bellmouth positioned at a second end of the sleeve opposite the end wall and including a second diameter larger than the first diameter, a bracket coupled to the sleeve;

a feed screw supported by and rotatable relative to the bracket;

a slide coupled to and movable along the feed screw relative to the sleeve;

an arm coupled to and movable with the slide relative to the sleeve;

a wheel coupled to and movable with the arm relative to the sleeve, wherein the wheel is adapted to rotate relative to the arm; and an actuator coupled to the arm and adapted to move the wheel between an engaged position, in which the wheel engages the pipe to remove the coating, and a disengaged position, in which the wheel is disengaged from the pipe.

13. The device of claim 12, further comprising a pair of guides coupled at their ends to the bracket, and wherein the slide is coupled to the guides and moves along the guides relative to the sleeve.

14. The device of claim 12, wherein the sleeve is adapted to rotate around the pipe.

15. The device of claim 12, wherein the end wall is adapted to engage an end of the pipe to limit insertion of the pipe into the sleeve.

16. The device of claim 12, further comprising a handle coupled to the end wall.

17. The device of claim 12, further comprising a first motor coupled to the feed screw to rotate the feed screw in a first direction to move the slide toward the first end of the sleeve and rotate the feed screw in a second direction to move the slide toward the second end of the sleeve; and a second motor coupled to the wheel to rotate the wheel.

18. An abrasive wheel comprising:

a hub having a periphery and defining a channel in a side of the hub;

an abrasive member partially positioned in the channel and including a portion thereof that extends out of the channel beyond the periphery of the hub; and a side plate coupled to the hub to secure the abrasive member in the channel between the hub and the side plate;

wherein the side is a first side of the hub, the channel is a first channel defined in the first side of the hub, the abrasive member is a first abrasive member, and the side plate is a first side plate coupled to the first side of the hub, wherein the hub includes a second side and defines a second channel in the second side, the abrasive wheel further comprising:

a second abrasive member partially positioned in the second channel and including a portion thereof that extends out of the second channel beyond the periphery of the hub; and a second side plate coupled to the second side of the hub to secure the second abrasive member in the second channel between the hub and the second side plate.

19. The abrasive wheel of claim 18, wherein the abrasive member is a wire rope.

* * * * *